US005128228A

United States Patent [19]

Ueda et al.

[11] Patent Number: 5,128,228

[45] Date of Patent: Jul. 7, 1992

[54] PHOTOSENSITIVE MEMBER COMPRISING SPECIFIC ANILINE DERIVATIVE

[75] Inventors: Hideaki Ueda, Kawanishi; Mitsutoshi Sakamoto, Osaka; Kimiyuki Ito, Kawanishi; Yuki Shimada, Suita, all of Japan

[73] Assignee: Minolta Camera Kabushiki Kaisha, Osaka, Japan

[21] Appl. No.: 592,781

[22] Filed: Oct. 4, 1990

[30] Foreign Application Priority Data

Oct. 5, 1989 [JP] Japan ..... 1-260657

[51] Int. Cl.[5] ..... G03G 5/047; G03G 5/14

[52] U.S. Cl. ..... 430/59; 430/66; 430/67

[58] Field of Search ..... 430/59

[56] References Cited

U.S. PATENT DOCUMENTS

| | | | |
|---|---|---|---|
| 4,450,218 | 5/1984 | Takei et al. | 430/59 |
| 4,591,542 | 5/1986 | Fujimaki et al. | 430/59 |
| 4,755,443 | 7/1988 | Suzuki et al. | 430/58 |
| 4,999,268 | 3/1991 | Ojima et al. | 430/59 |

FOREIGN PATENT DOCUMENTS

| | | | |
|---|---|---|---|
| 57-122444 | 7/1982 | Japan . | |
| 1155 | 1/1983 | Japan | 430/59 |
| 61-35452 | 2/1986 | Japan . | |
| 61-77054 | 4/1986 | Japan . | |
| 63-4238 | 1/1988 | Japan . | |
| 63-73256 | 4/1988 | Japan . | |
| 96662 | 4/1988 | Japan | 430/59 |
| 2201254A | 8/1988 | United Kingdom . | |

*Primary Examiner*—Roland Martin

*Attorney, Agent, or Firm*—Burns, Doane, Swecker & Mathis

[57] ABSTRACT

This invention relates to a photosensitive member with a charge generating layer and a charge transporting layer laminated on an electrically conductive substrate, in which the charge transporting layer comprises a charge transporting material and an aniline derivative represented by the following general formula [I] below;

[I]

in which $R_1$ and $R_2$ are respectively an alkyl group or an aralkyl group, each of which may have a substituent; $R_3$–$R_7$ are respectively a hydrogen atom, an alkyl group, an alkoxy group, a hydroxy group, an aryl group, an aralkyl group or a halogen atom.

28 Claims, No Drawings

PHOTOSENSITIVE MEMBER COMPRISING SPECIFIC ANILINE DERIVATIVE

BACKGROUND OF THE INVENTION

This invention relates to a laminated-type photosensitive member with at least a charge generating layer and a charge transporting layer on an electrically conductive substrate. In particular, the photosensitive member in improved in repetition-use properties and life of the charge transporting layer.

In general electrophotography, many methods for forming copied images are known. For example, the surface of a photosensitive member is charged and irradiated to form electrostatic latent images thereon, the electrostatic latent images are developed to visible images by a developer, and then the developed images are fixed directly onto the photosensitive member (this method is referred to as a direct method). Alternatively, developed electrostatic latent images on a photosensitive member which are made visible by a developer are transferred to a copying paper and then, the transferred images are fixed on the copying paper (this method is referred to as a powder transferring method). In another method, electrostatic latent images on a photosensitive member are transferred onto a copying paper, the transferred electrostatic latent images are developed by a developer and then fixed on the copying paper (referred to as an electrostatic latent image transferring method).

With respect to photoconductive materials conventionally used for forming a photosensitive layer, inorganic photoconductive materials such as selenium, cadnium sulfide, zinc oxide and the like are known.

These photoconductive materials have many advantages, such as ability to be charged to an adequate potential, low loss of electrical charges in the dark, a rapid dissipation of electrical charges with irradiation of light and the like. However, they have disadvantages. For example, a photosensitive member based on selenium is difficult to produce, has high production costs and difficult to handle due to inadequate resistivity to heat or mechanical impact. A photosensitive member based on cadmium sulfide has defects such as its unstable sensitivity in a highly humid environmental and loss of stability with time because of the deterioration of dyestuffs, added as a sensitizer, by corona charge and fading with exposure.

Many kinds of organic photoconductive materials such as polyvinylcarbazole and so on have been proposed. These organic photoconductive materials have superior film forming properties, are light in weight, etc., but inferior in sensitivity, durability and environmental stability compared to the aforementioned inorganic photoconductive materials.

In order to overcome the above mentioned problems, current researches and developments have proposed that the functions of charge generation and charge transportion in a photosensitive layer are divided to form a function-devided photosensitive member of a laminated type in which a charge generating layer and a charge transporting layer are laminated on an electrically conductive substrate, such as aluminium, copper or the like.

Such a function-devided photosensitive member of a laminated type is very high in productivity and cheap in production cost because it can be prepared generally by a coating method. Further, the wavelength region sensitive to light can be controlled freely by the adequate selection of a charge generating material. Therefore, the function-devided photosensitive member of the laminated type has been used widely in recent years.

It is necessary that the basic performances requisite for a photosensitive member, such as charge keeping properties, high sensitivity, repetition stability, resistance to break down, resistance to wearing, durability, resistance to humidity, transferring properties, cleaning properties, preservation properties and the like, are provided for the laminated-type photosensitive member. As the laminated type photosensitive member is applied to a laser printer or the like, higher reliability to copied images and higher repetition stability are required than before.

Therefore, a charge transporting layer is formed usually at the surface side of a photosensitive member in consideration of the durability with respect to toner cleaning of the surface of the photosensitive member after toner transferring process and the influences of surface injury and irregular layer-thickness on copied images.

However, such a photosensitive member with a charge transporting layer at the surface side has problems as before, such as irregular layer-thickness of the photosensitive member, cleaning failure of the surface of the photosensitive member, ununiform density of copied images resulted from degradation caused by humidity or ozone, and the like. When a copy process is repeated several hundreds of times continuously, there arise problems such as the shades in copied images, blurred copied images or the like.

In particular, the problems as above mentioned are remarkable in the case where a photosensitive member is applied to a laser printer which requires high reliability to copied images and repetition stability. Accordingly, a photosensitive member which can be applied to such a laser printer without such problems has been desired.

The problems as above mentioned are caused by degradation influenced by circumstances of ozone which are formed in continually repeated corona-charge processes of a charge transporting layer. Therefore, in order to prevent the degradation, gasses, such as ozone and the like, in the corona-charger neighborhood are exhausted mechanically. This mechanical means cannot overcome the problems completely.

In particular, when a photosensitive member is charged negatively, active gasses, such as ozone, $NO_x$ and the like are liable to generate by corona-discharges in a great amount and the photosensitive member is much influenced adversely by their gasses.

Accordingly, charge-transporting materials of electron-donating type and resins of charge transporting layers are much deteriorated, resulting in the defects of copied images, such as ununiform copied images and blurred copied images and the like, the lowering of the surface potential at the repeated uses and the lowering of the density of copied images.

Moreover, a coating solution for the preparation of a photosensitive member is influenced by light, acidic materials to arise such deteriorations as increase of viscosity, yellowing or the like.

The inventions in which a nitrogen-containing material is contained in a photosensitive layer of a photosensitive member for electrophotography are disclosed in Japanese laid-open Nos sho 63-4238, 63-73256, 63-18355 and 57-122444. But, the nitrogen-containing material is completely different in the chemical structure from that of the present invention which is going to be disclosed below.

SUMMARY OF THE INVENTION

The object of the present invention is to provide a photosensitive member improved in prevention of degradation of the surface of a photosensitive member caused by oxidation (by ozone or the like) and excellent in sensitivity and repetition properties.

The other object of the present invention is to provide a photosensitive member prepared by using a photoconductive coating solution excellent in stability and coatability.

The present invention relates to a photosensitive member with a charge generating layer and a charge transporting layer laminated on an electrically conductive substrate, characterized by that the charge transporting layer comprises a charge transporting material and an aniline derivative represented by the following general formula [I]:

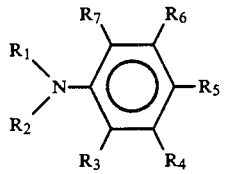

[I]

in which $R_1$ and $R_2$ represent respectively an alkyl group or an aralkyl group, each of which may has a substituent; $R_3$–$R_7$ represent respectively a hydrogen atom, an alkyl group, an alkoxy group, a hydroxy group, an aryl group, an aralkyl group or a halogen atom.

DETAILED DESCRIPTION OF THE INVENTION

The present invention provides a photosensitive member excellent in resistance to oxidation by ozone or the like and stability of copied images, repetition stability, and resistance to deterioration with time.

The present invention has accomplished the above object by introduction of a specific aniline derivative into a charge transporting layer of a function-devided photosensitive member.

The aniline derivative contained in the charge transporting layer is represented by the following general formula [I]:

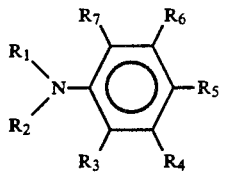

[I]

in which $R_1$ and $R_2$ are respectively an alkyl group or an aralkyl group, each of which may have a substituent; $R_3$–$R_7$ are respectively a hydrogen atom, an alkyl group, an alkoxy group, a hydroxy group, an aryl group, an aralkyl group or a halogen atom.

The incorporation of the aniline derivative represented by the general formula [I] effects the prevention of oxidation by ozone or the like, high stability of copied images, repetition stability and resistance to deterioration with time.

In the general formula [I], $R_1$ and $R_2$ are respectively an alkyl group, such as a lower alkyl group or the like, an aralkyl group, such as benzyl, phenethyl or the like, each of which may have a substituent. $R_3$–$R_7$ are respectively a hydrogen atom, an alkyl group, such as a $C_1$–$C_3$ lower alkyl group or the like, an alkoxy group, such as a $C_1$–$C_3$ lower alkoxy group or the like, a hydroxy group, an aryl group, such as phenyl or the like, an aralkyl group, such as benzyl, phenethyl or the like, a halogen atom, such as fluorine, chlorine or the like.

Preferable aniline derivatives represented by the general formula [I] have two or three substituents bonding to the benzine ring. More preferably, $R_3$, $R_5$ and $R_7$ are respectively an alkyl group at the same time.

The aniline derivative represented by the general formula [I] is shown concretely as below, but these are shown with no significance in restricting the embodiments of the invention.

[1]

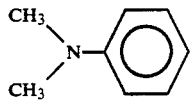

[2]

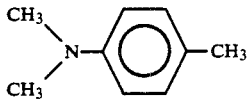

[3]

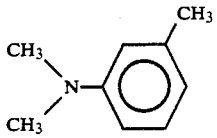

[4]

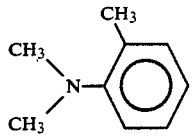

[5]

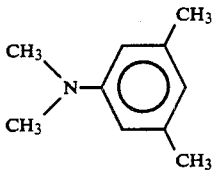

[6]

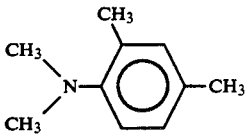

[7]

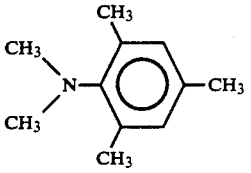

[8]

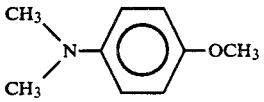

-continued
[9]
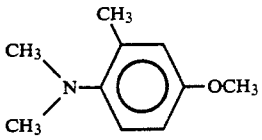
[10]
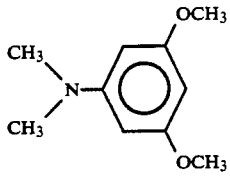
[11]
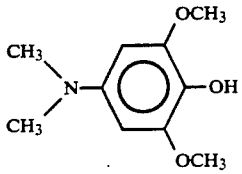
[12]
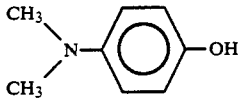
[13]
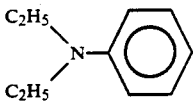
[14]
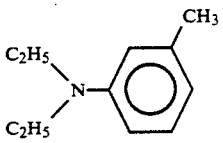
[15]
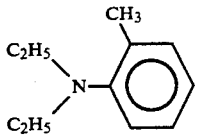
[16]
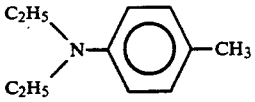
[17]
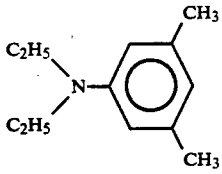
[18]
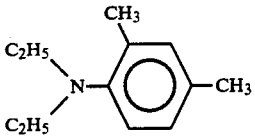
-continued
[19]
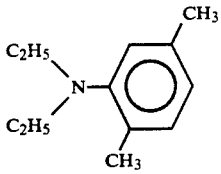
[20]
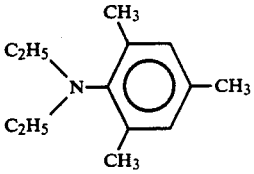
[21]
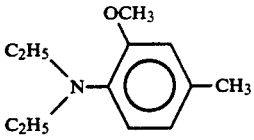
[22]
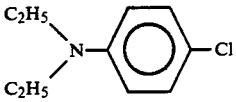
[23]
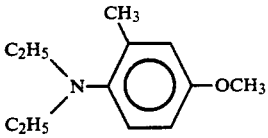
[24]
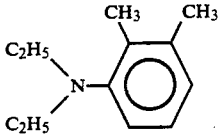
[25]
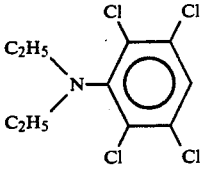
[26]
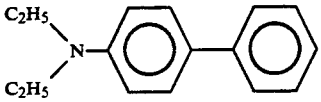
[27]
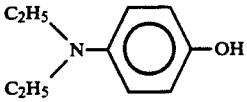
[28]
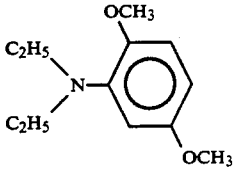

-continued
[29]
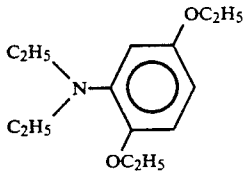
[30]
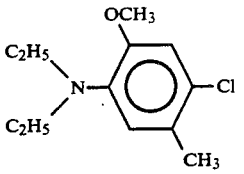
[31]
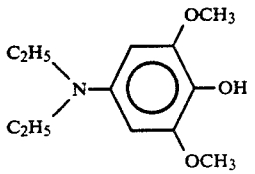
[32]
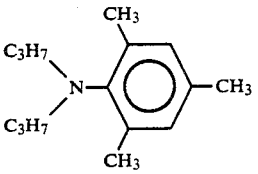
[33]
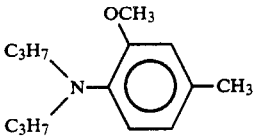
[34]
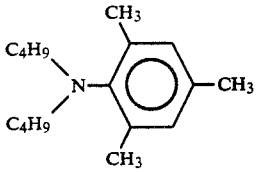
[35]
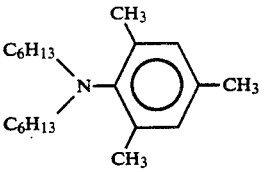
[36]
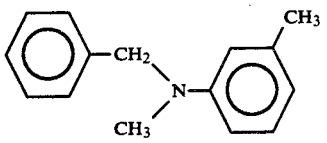
[37]
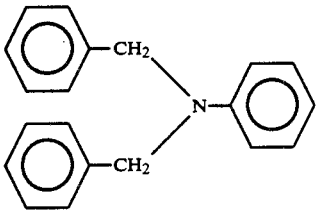
-continued
[38]
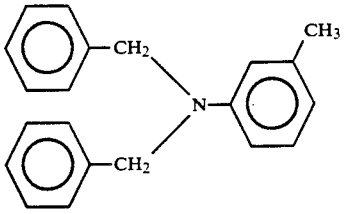
[39]
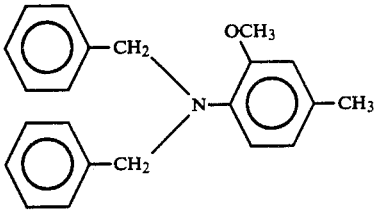
[40]
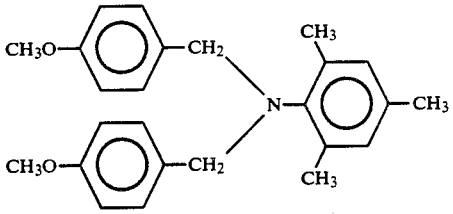
[41]
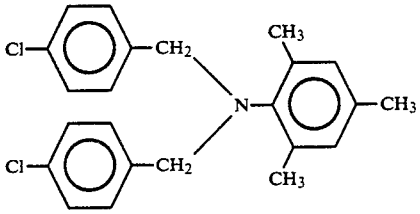
[42]
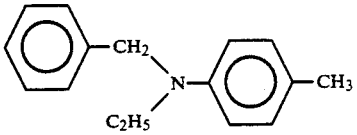
[43]
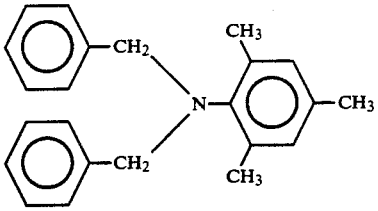
[44]
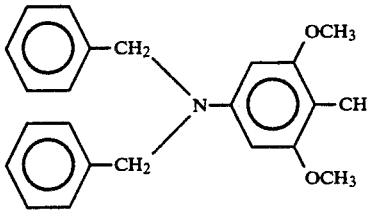
Further favourably, the stability of the coating solution is improved, when the aniline derivative represented by the general formula [I] is dispersed in a binder resin together with a charge transporting material to prepare a coating solution for the formation of a charge transporting layer.

With respect to a charge transporting material contained in a charge transporting layer, various kinds of compounds may be used, such as hydrazone compounds, pyrazoline compounds, styryl compounds, triphenylmethane compounds, oxazole compounds, oxadiazole compounds, carbazole compounds, butadiene compounds, stilbene compounds, enamine compounds, triphenyl-amine compounds, tetraphenyl benzidine compounds, azine compounds and the like.

In order to obtain the effects of the present invention more effectively, it is preferable to use the aniline compounds represented by the general formula [I] in combination with a charge transporting material selected from the group consisting of a butadiene compound represented by the following general formula [II] below and a distyryl compound represented by the following general formula [III] below:

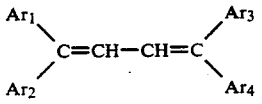

[II]

in which $Ar_1$, $Ar_2$, $Ar_3$ and $Ar_4$ are respectively an aryl group; at least one group among $Ar_1$, $Ar_2$, $Ar_3$ and $Ar_4$ has a substituent;

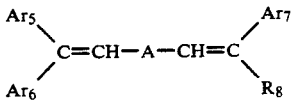

[III]

in which $Ar_5$, $Ar_6$ and $Ar_7$ are respectively an aryl group; at least one group among $Ar_5$, $Ar_6$ and $Ar_7$ has a substituent. The group "A" is an alkylene group, an arylene group or a bivalent group, each of which may have a substituent; $R_8$ is a hydrogen atom, an alkyl group, an aralkyl group or an aryl group, each of which may have a substituent except for the hydrogen atom.

In more detail, in the general formula [II], $Ar_1$–$Ar_4$ are respectively an aryl group, such as phenyl or the like. At least one group among $Ar_1$, $Ar_2$, $Ar_3$ and $Ar_4$ has at least one of substituents, such as a halogen atom, a lower alkoxy group, a N-substituted amino group, a lower alkyl group or the like. The preferable substituent among those substituents is the N-substituted amino group. If any of $Ar_1$–$Ar_4$ has not substituent, the sensitivity and the compatibility with a resin become poor.

The butadiene compound represented by the general formula [II]is shown concretely as below, but these are shown with no significance in restricting the embodiments of the invention.

[45]

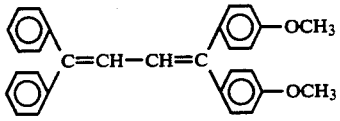

[46]

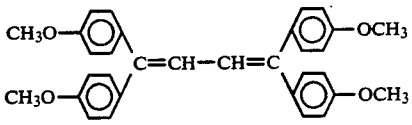

-continued

[47]

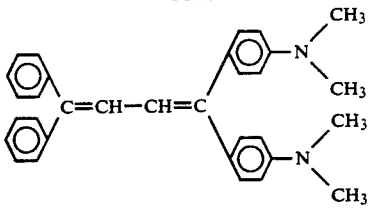

[48]

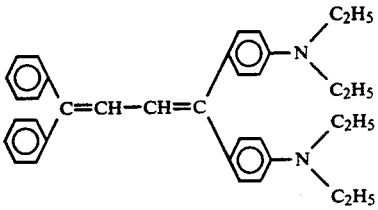

[49]

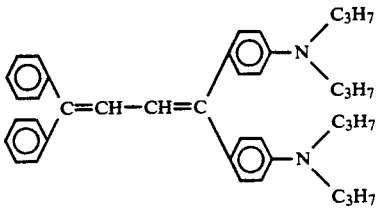

[50]

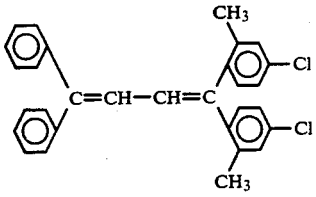

[51]

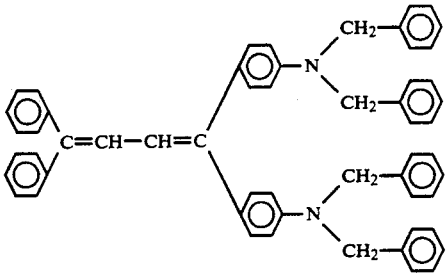

[52]

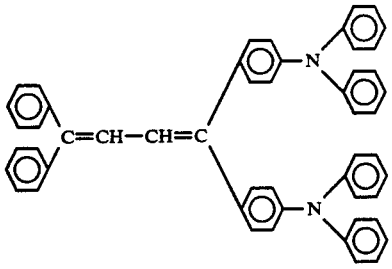

[53]

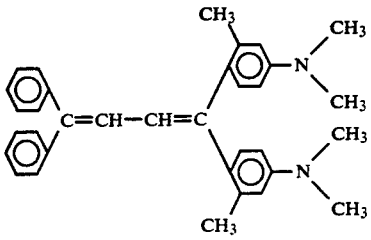

-continued

[54]

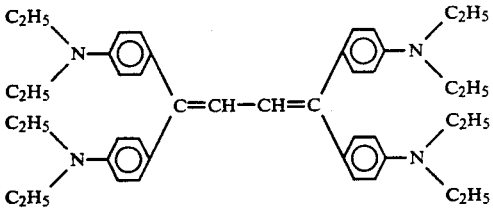

[55]

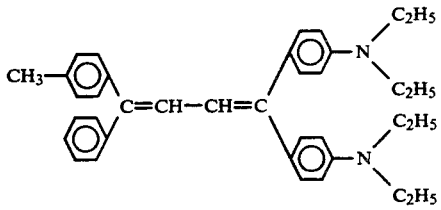

[56]

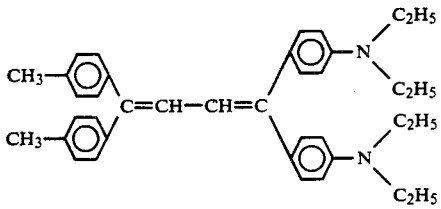

[57]

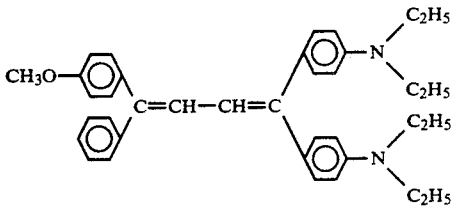

[58]

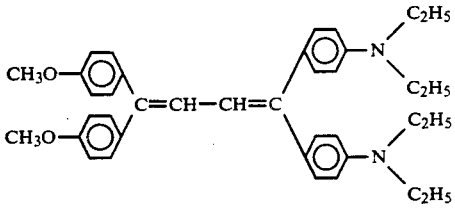

[59]

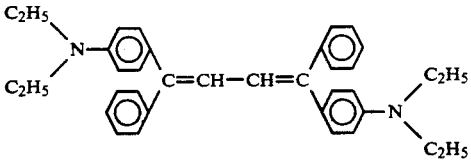

-continued

[60]

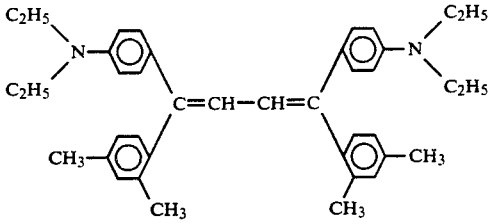

[61]

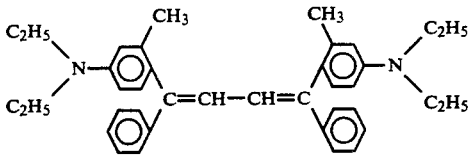

[62]

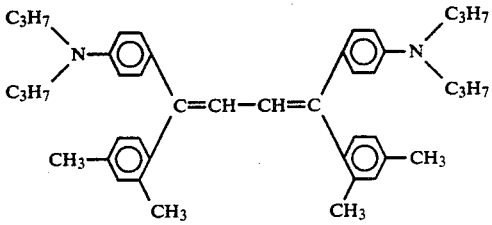

The butadiene compounds are the ones numbered by [48], [49], [53], [55], [56], [57], [58], [59], [60], [61] and [62] are particularly preferable.

In the general formula [III], $Ar_5$, $Ar_6$ and $Ar_7$ are respectively an aryl group, such as phenyl or the like. At least one group among $Ar_5$, $Ar_6$ and $Ar_7$ has at least one of substituents, such as a lower alkoxy group, a N-substituted amino group, a lower alkyl group or the like. The preferable substituent among those substituents is the N-substituted amino group. When any of $Ar_5$–$Ar_7$ has not a substituent, at least one of $Ar_5$–$Ar_7$ may be the residual group of heterocyclic ring having a nitrogen atom or an oxygen atom, such as carbazole, dioxaindane or the like. If any of $Ar_5$–$Ar_7$ has not substituent, or if any of $Ar_5$–$Ar_7$ is not such a residual group of heterocyclic ring as above mentioned, the sensitivity and the compatibility with a resin become poor.

In the general formula [III], $R_8$ is a hydrogen atom, an alkyl group, such as an $C_1$–$C_3$ lower alkyl group, an aralkyl group, such as benzyl or the like, an aryl group, such as phenyl or the like. $R_8$ may have the same substituent as the one described for $Ar_5$–$Ar_7$.

In the general formula [III], the group "A" is an arylene group, such as phenylene or the like, a bivalent group of heterocyclic ring, such as thiol, furan or the like. The group "A" may have a substituent, such as an alkyl group, an alkoxy group or the like.

The distyryl compound represented by the general formula [III] is shown concretely as below, but these are shown with no significance in restricting the embodiments of the invention.

[63]

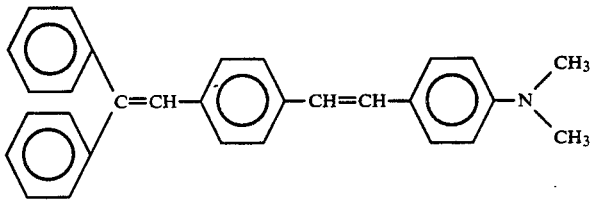

-continued
[64]
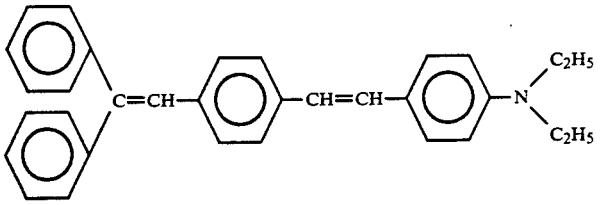
[65]
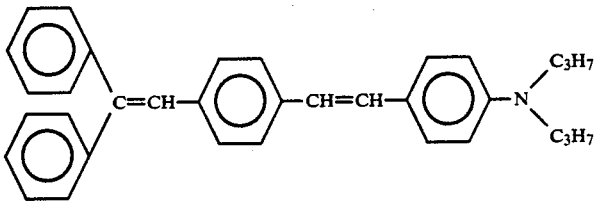
[66]
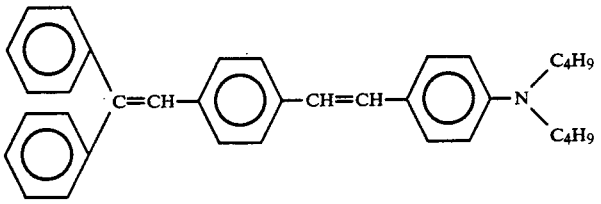
[67]
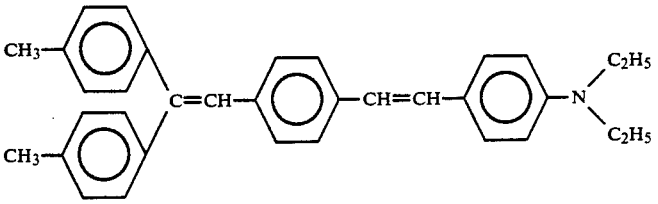
[68]
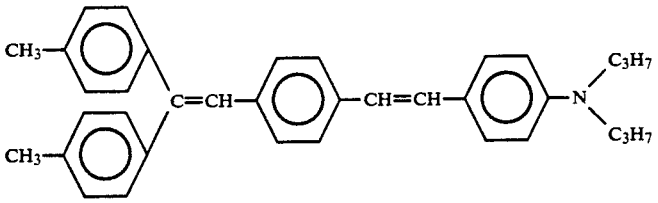
[69]
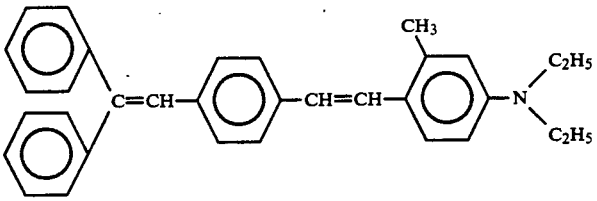
[70]
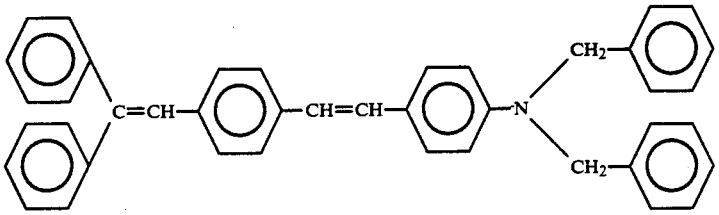

-continued
[71]
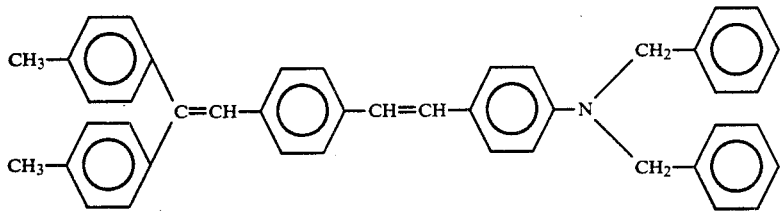
[72]
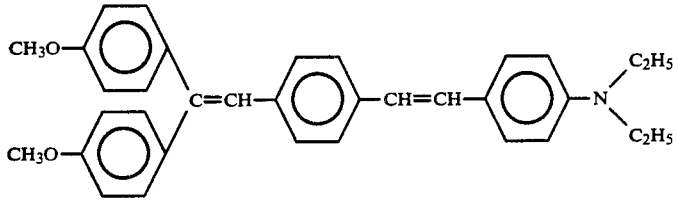
[73]
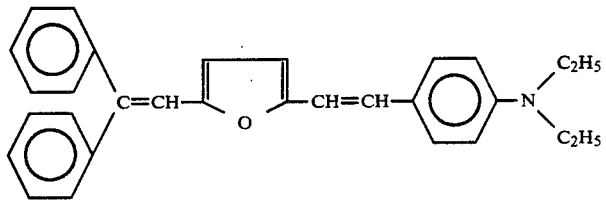
[74]
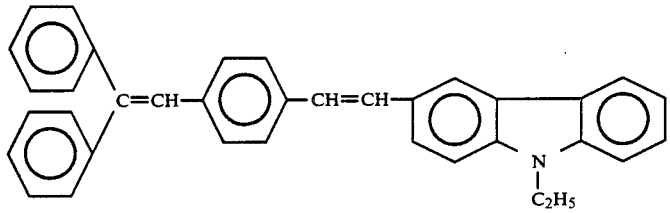
[75]
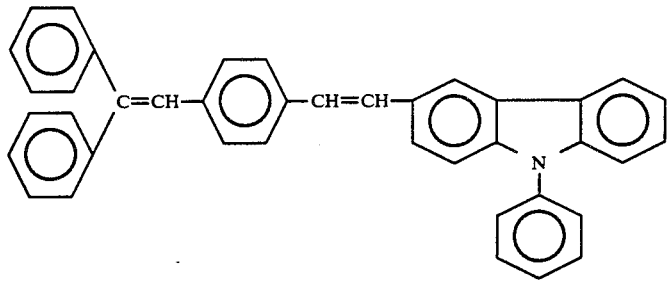
[76]
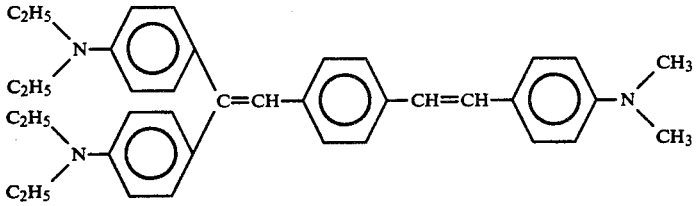
[77]
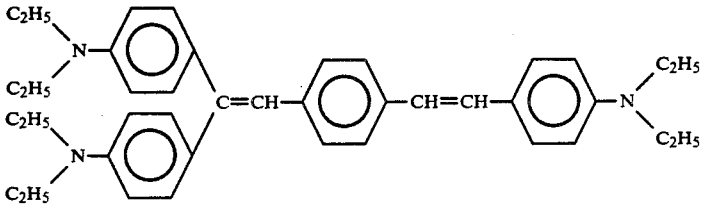

-continued
[78]
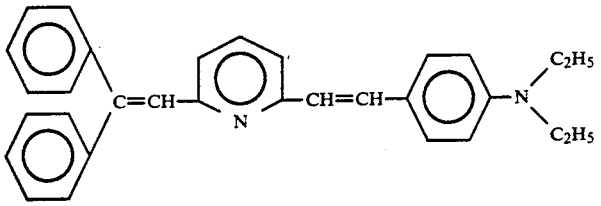
[79]
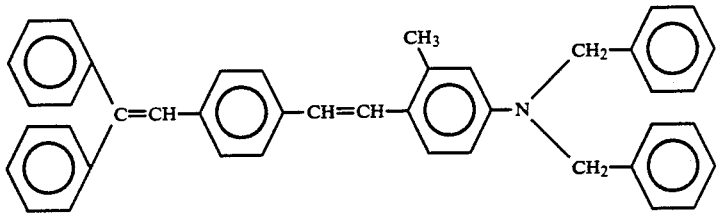
[80]
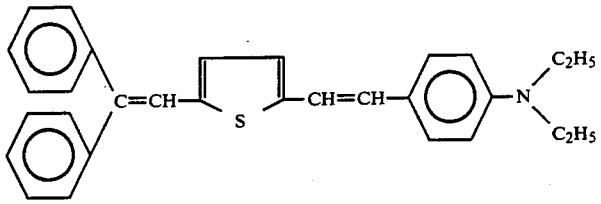
[81]
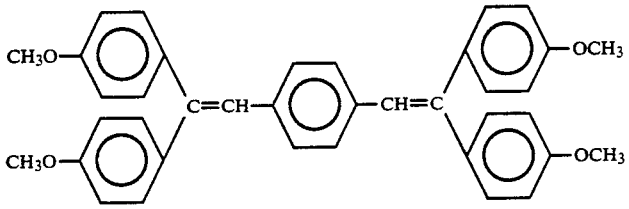
[82]
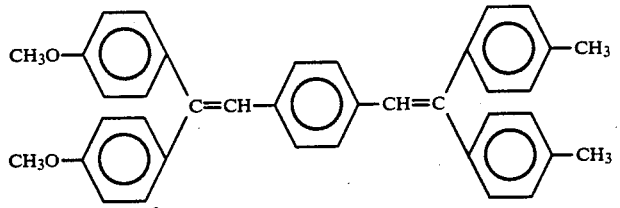
[83]
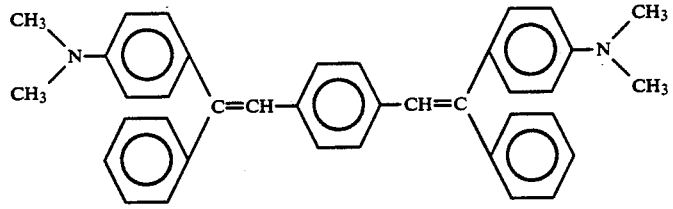
[84]
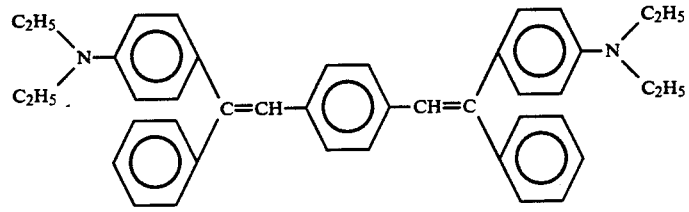

-continued
[85]
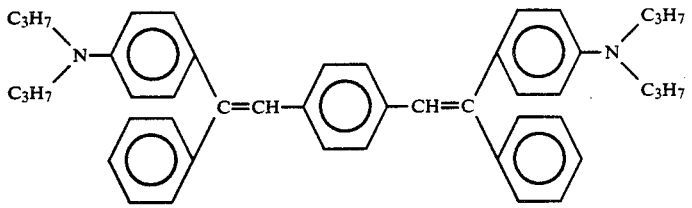
[86]
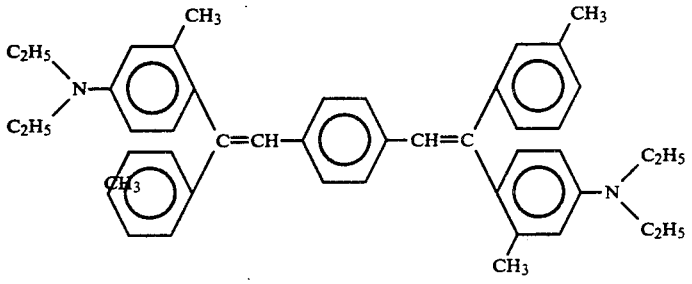
[87]
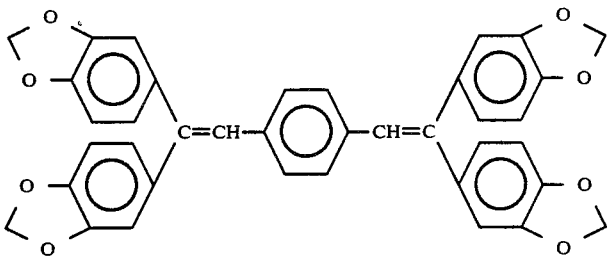
[88]
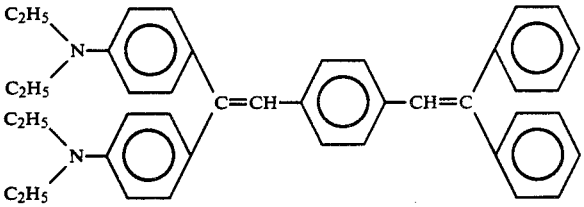
[89]
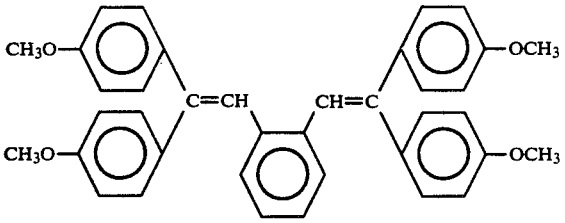
[90]
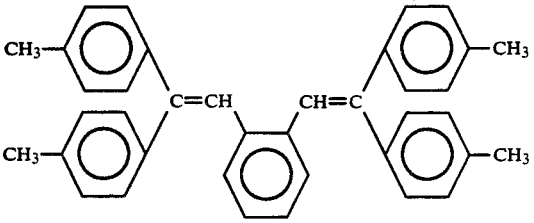

-continued
[91]
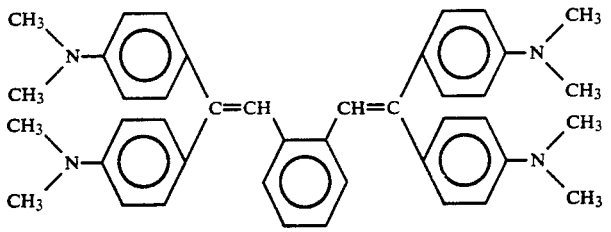
[92]
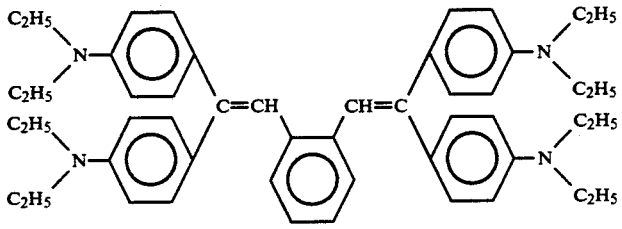
[93]
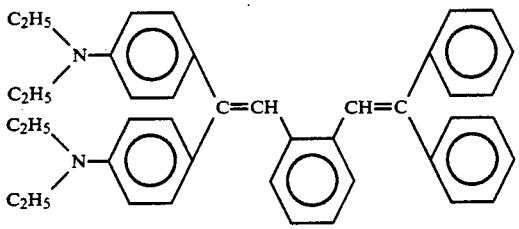
[94]
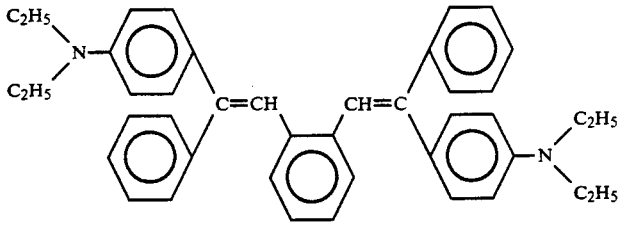
[95]
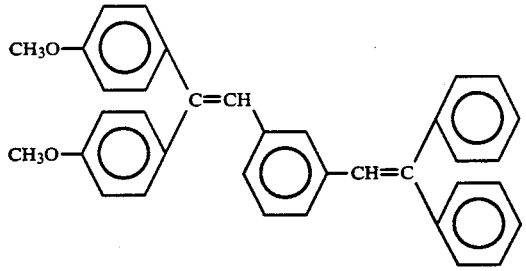
[96]
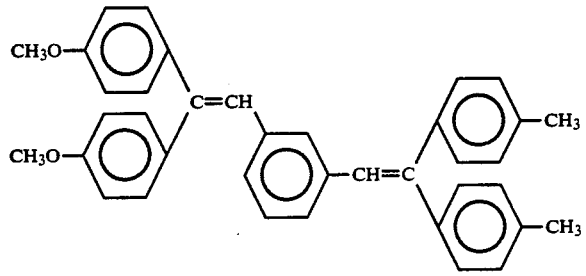

-continued
[97]
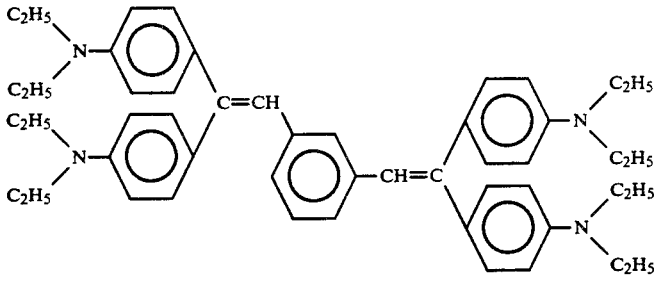
[98]
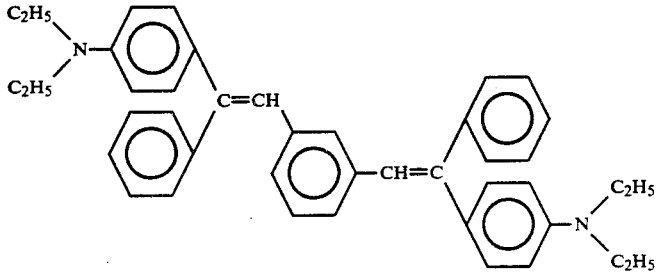
[99]
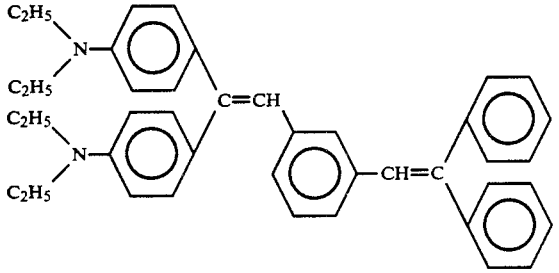
[100]
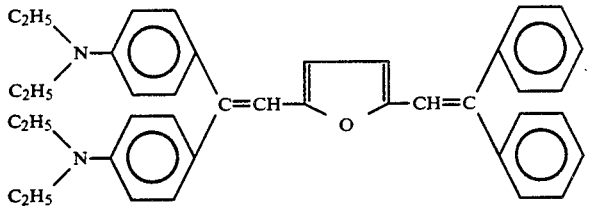
[101]
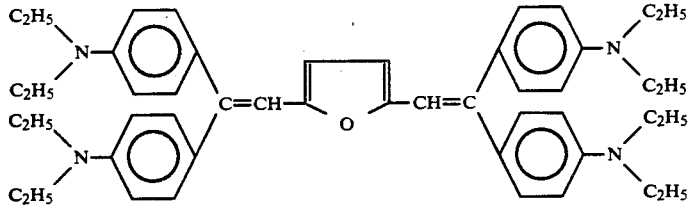
[102]
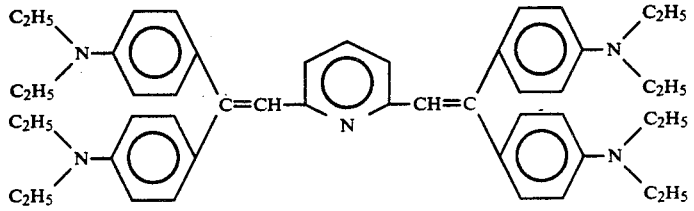

-continued
[103]
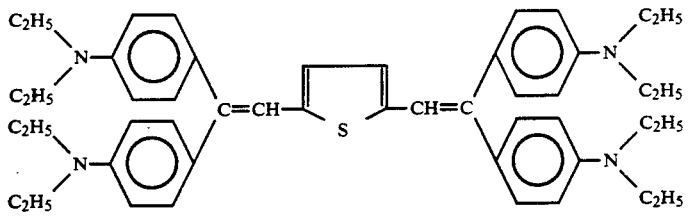
[104]
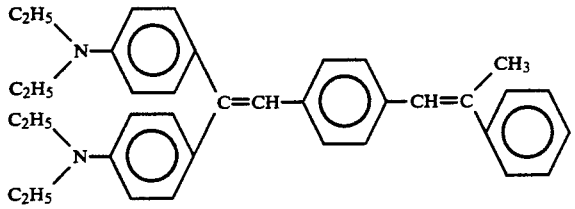
[105]
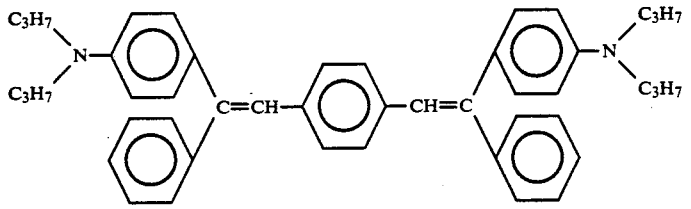
[106]
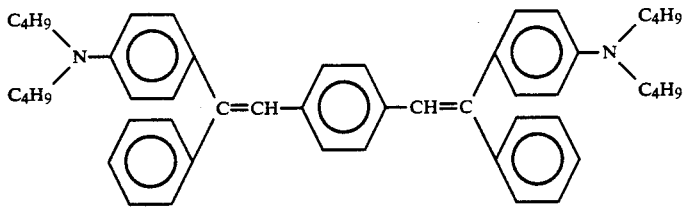
[107]
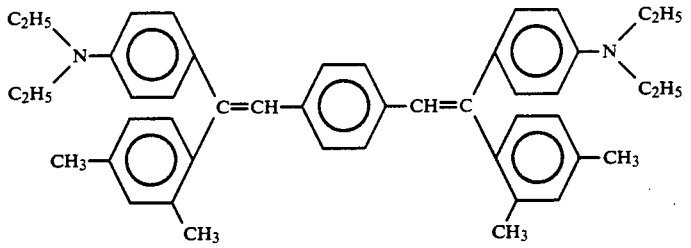
[108]
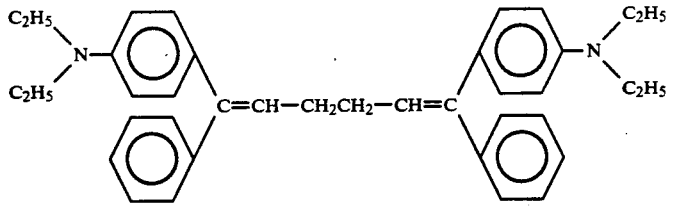
[109]
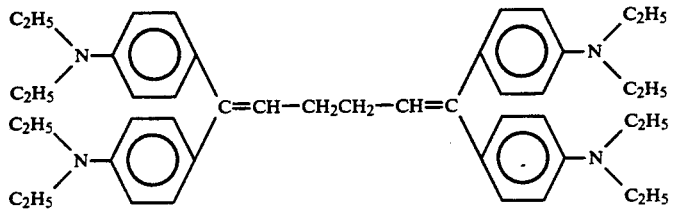
The compounds numbered by [64], [66], [67], [69], [70], [71], [72], [77], [79], [85], [86], [88], [92], [93], [94], [97], [98], [99], [100,], [101], [104], [105], [107] and [108] are particularly preferable.

The preparation example of a laminated-type photosensitive member with a charge generating layer and a charge transporting layer laminated on an electrically conductive substrate is explained in detail hereinafter, using an aniline derivative represented by the general formula [I].

An electrically conductive substrate is exemplified by a sheet or a drum made of metal or alloy, such as copper, aluminium, silver, iron, nickel and the like; a substrate, such as a plastic film, on which the foregoing metal or alloy is adhered by a vacuum-deposition method or an electroless plating method and the like; a substrate, such as a plastic film and paper, on which an electroconductive layer is formed by applying or depositing electroconductive polymer, indium oxide, tin oxide etc..

When a charge generating layer is formed on such an electrically conductive substrate as above mentioned, a charge generating material may be deposited in a vacuum or plasma-polymerized on the electrically conductive substrate, or a charge generating material is dispersed in an solution with an adequate resin dissolved therein to apply the dispersion onto the electrically conductive substrate, followed by drying, so that the obtained charge generating layer may be 0.01–2 μm, preferably 0.1–1 μm in thickness.

Examples of charge generating materials contained in a charge generating layer are organic pigments or dyes, such as bisazo dyes, triarylmethane dyes, thiazine dyes, oxazine dyes, xanthene dyes, cyanine coloring agents, styryl coloring agents, pyrylium dyes, azo pigments, quinacridone pigments, indigo pigments, perylene pigments, polycyclic quinone pigments, bisbenzimidazole pigments, indanthrone pigments, squalylium pigments, phthalocyanine pigments and the like; and inorganic substances, such as selenium, selenium-tellurium, selenium-arsenic, cadmium sulfide, zinc oxide, titanium oxide, amorphous silicon and the like.

Examples of binder resin used together with the charge generating materials are thermoplastic binders, such as saturated polyester resin, polyamide resin, acrylic resin, ethylene-vinyl acetate copolymer, ion-crosslinked olefin copolymer (ionomer), styrene-butadiene block copolymer, polyarylate, polycarbonate, vinyl chloride-vinyl acetate copolymer, cellulose ester, polyimides, styrol resins, polyacetal resins, phenoxy resins and the like; thermosetting binders, such as epoxy resins, urethane resins, silicone resins, phenolic resins, melamine resins, xylene resins, alkyd resins, thermosetting acrylic resins and the like; light-curable resins; photoconductive resins, such as poly-N-vinylcarbazoles, polyvinylpyrenes, polyvinylanthracenes and the like.

then, the charge generating material is dispersed or dissolved together with the binder resin in an organic solvent, for example, alcohols, such as methanol, ethanol, isopropanol and the like, ketones, such as acetone, methyl ethyl ketone, cyclohexanone and the like, amides, such as N,N-dimethylformamide, N,N-dimethylacetamide and the like, sulfoxides, such as dimethylsulfoxide and the like, ethers, such as tetrahydrofuran, dioxane, monomethyl ether of ethylene glycol and the like, esters, such as methyl acetate, ethyl acetate and the like, aliphatic halogenated hydrocarbons, such as chloroform, methylene chloride, dichloroethylene, tetrachlorocarbon, trichloroethylene and the like, and aromatic compounds, such as benzene, toluene, xylene, ligroin, monochlorobenzene, dichlorbenzene and the like. Thus, a photosensitive solution is prepared. The photosensitive solution is applied onto the electrically conductive substrate, followed by drying, to form a charge generating layer.

A coating solution as prepared above may be applied onto the electrically conductive substrate by a known method, such as a dipping coating method, a spray coating method, a spinner coating method, a blade coating method, a roller coating method, a wire-bar coating method or the like.

Then, a charge transporting layer is formed on the above obtained charge generating layer. The same binder resin as used for the preparation of charge generating layer and a charge transporting material selected, in particular, from a butadiene compound represented by the general formula [II] or s styryl compound represented by the general formula [III] are dissolved in the same adequate solvent as above mentioned in combination with an aniline derivative represented by the general formula [I] to prepare a coating solution. The obtained coating solution is applied onto the charge generating layer, followed by drying. In this case, the charge transporting layer is formed so that the layer thickness may be 3–40 μm, preferably 5–25 μm.

The charge transporting material is contained in the charge transporting layer at the content of 0.02–2 parts by weight, preferably 0.5–1.2 parts by weight on the basis of one part by weight of the binder resin. When more than two kinds of charge transporting materials are used, the total amount thereof is adjusted within the above mentioned range.

The content of the aniline derivative contained in the charge transporting layer is 1–30 percents by weight, preferably 5–25 percents by weight on the basis of the amount of the charge transporting material. If the content is less than 1 percent by weight, the effects of the present invention are not obtained satisfactorily. If the content is more than 30 percents by weight, the sensitivity becomes poor, and the repeated use leads to the increase of the residual potential. When more than two kinds of aniline derivatives are used, the total amount thereof is adjusted within the above mentioned range.

A levelling agent, such as silicon oil or the like may be added into the charge transporting layer to achieve the further improvement of the stability of copied images, the decrease of noises in copied images and the improvement of the durability.

A sensitizer, a bodying agent, a surfactant or the like, per se known, may be added into the charge transporting layer.

If necessary, an intermediate layer may be formed between the electrically conductive substrate and the photosensitive layer, and a surface protective layer may be formed on the photosensitive layer.

With respect to a material used for the intermediate layer, a polymer itself, such as polyimide, polyamide, nitrocellulose, polyvinylbutyral or the like, a polymer thereof with a compound of low electrical resistance, such as tin oxide indium oxide or the like dispersed therein, or a deposition layer, such as aluminum oxide, zinc oxide, silicon oxide or the like are exemplified. It is desirable that the intermediate layer is formed so that the thickness may be 1 μm or less.

With respect to a material used for the surface protective layer, a polymer itself, such as acrylic resin, polyallyl resin, polycarbonate resin, urethane resin or the like, or a polymer thereof with a compound of low electrical resistance, such as tin oxide, indium oxide or the like dispersed therein. Further, an organic plasma-polymerized layer may be used. An oxygen atom, a nitrogen atom, a halogen atom, an atom of the group III or V in the periodic Table or the like may be incorporated, if necessary. It is desirable that the surface protective layer is formed so that the thickness may be 5 μm or less.

The present invention is exemplified by examples. In the examples, "part(s)" means "parts(s) by weight".

EXAMPLE 1

As for an electrically conductive substrate, an aluminium drum of 50 mm in outer diameter and 254 mm in length was used.

The bisazo pigment represented by the following structural formula:

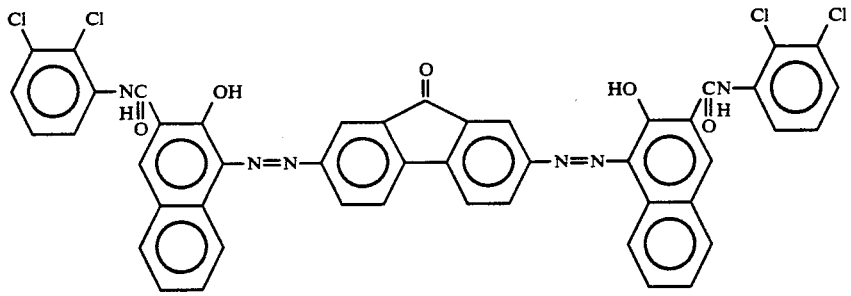

of 0.45 parts and polyester (Vylon 200; made by Toyobo K.K.) of 0.45 parts and cyclohexane of 50 parts were placed into a sand mill. The obtained dispersion of bisazo compound were applied onto the aluminium drum to form a charge generating layer so that the layer thickness might be 0.3 g/m$^2$ after dried.

Fifty parts of the butadiene compound [48], 50 parts of polycarbonate (Panlite K-1300; made by Teijin Kasei K.K.), 5 parts of the aniline derivative [7] and 0.05 parts of fluorosilicone oil (X-22-819; made by Shinetsu Kagaku K.K.) were dissolved in 400 parts of 1,4-dioxane. The obtained solution was applied onto the charge generating layer to form a charge transporting layer, so that the layer thickness might be 20 μm after dried.

Thus, a photosensitive member for electrophotography having a two-layered photosensitive layer was prepared.

EXAMPLE 2-5

Photosensitive members were prepared in a manner similar to Example 1, except that the aniline derivative [7] of 2.5 parts, 7.5 parts, 10 parts and 12.5 parts was incorporated into a charge transporting layer.

EXAMPLE 6

Bisazo pigment represented by the structural formula:

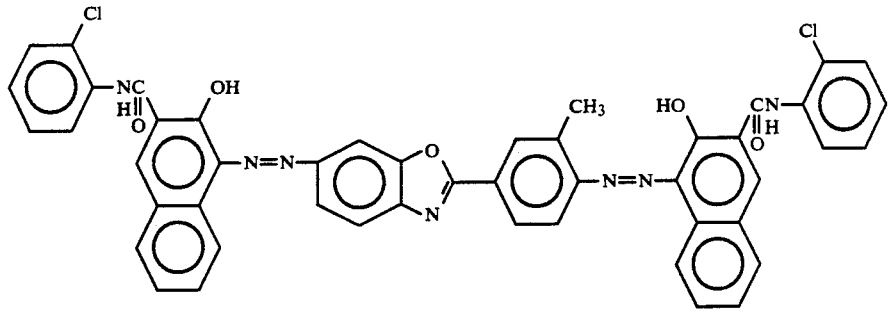

of 0.45 parts, polystyrene resin (molecular weight: 40,000) of 0.45 parts and 1,1,2-trichloroethane of 50 parts were placed into a sand mill for dispersion.

The obtained dispersion of the bisazo pigment were applied onto an aluminium drum to form a charge generating layer so that the layer thickness might be 0.3 g/m$^2$ after dried.

Twenty five parts of the butadiene compound [49], 25 parts of the distyryl compound [88], 50 parts of polycarbonate (NOVAREX 7030; made by Mitsubishi Kasei K.K.), 7.5 parts of aniline derivative [10], and 0.1 part of fluorosilicone oil [FL-100; made by Shinetsu Kagaku K.K.) were dissolved in 400 parts of tetrahydrofuran. The obtained solution was applied onto the charge generating layer to form a charge transporting layer, so that the layer thickness might be 20 μm after dried.

Thus, a photosensitive member for electrophotography having a two-layered photosensitive layer was prepared.

EXAMPLES 7-10

Photosensitive members were prepared in a manner similar to Example 6, except that butadiene compounds, distyryl compounds and aniline derivatives shown in Table 1 were incorporated into a charge transporting layer.

TABLE 1

| Example No. | butadiene compound [No.] | distyryl compound [No.] | aniline derivative [No.] |
|---|---|---|---|
| 7 | [55] 40 parts | [64] 10 parts | [18] 5 parts |
| 8 | [57] 30 parts | [66] 20 parts | [20] 4 parts |
| 9 | [60] 20 parts | [70] 20 parts | [21] 7.5 parts |
| 10 | [62] | [79] | [23] |

TABLE 1-continued

| Example No. | butadiene compound [No.] | distyryl compound [No.] | aniline derivative [No.] |
|---|---|---|---|
| | 10 parts | 40 parts | 3 parts |

EXAMPLE 11

Metal-free phthalocyanine of Γ type of 0.45 parts, butyral resin (BX-1; made by Sekisui Kagaku Kogyo K.K.) of 0.45 parts and dichloroethane of 50 parts were taken into a sand mill for dispersion.

The obtained dispersion of the phthalocyanine were applied onto an aluminium drum to form a charge generating layer, so that the layer thickness might be 0.2 $g/m^2$ after dried.

The distyryl compound [77] of 50 parts, polycarbonate resin (PC-Z; made by Mitsubishi Gas Kagaku K.K.) and the aniline derivative [28]) of 10 parts were dissolved in THF of 400 parts.

The obtained solution was applied onto the charge generating layer to form a charge transporting layer, so that the layer thickness might be 20 μm after dried.

Thus, a photosensitive member for electrophotography having a two-layered photosensitive layer was prepared.

EXAMPLES 12-16

Photosensitive members were prepared in a manner similar to Example 11, except that distyryl compounds and aniline derivatives shown in Table 2 were incorporated into a charge transporting layer.

TABLE 2

| Example No. | distyryl compound [No.] | aniline derivative [No.] | additive* amount (part(s)) |
|---|---|---|---|
| 12 | [67] | [30] | 1.5 |
| 13 | [70] | [32] | 2.5 |
| 14 | [86] | [33] | 5 |
| 15 | [98] | [34] | 10 |
| 16 | [107] | [43] | 15 |

*The additive amount of the aniline derivative.

COMPARATIVE EXAMPLES 1-10

Photosensitive members were prepared in a manner similar to Example 11, except that the additives shown in Table 3 were incorporated instead of aniline derivative [28].

TABLE 3

| Comparative Example [No.] | additive |
|---|---|
| 1 | none |
| 2 | N-phenyl-β-naphthylamine |
| 3 | 6-ethoxy-2,2,4-trimethyl-1,2-dihydroquinoline |
| 4 | tri-nonylphenyl-phosphite |
| 5 | 2-hydroxy-4-n-octoxy-benzo-phenone |
| 6 | 2-(2'-hydroxy-5'-methylphenyl) benzotriazole |
| 7 | bis-(2,2,6,6-tetramethyl-4-piperidyl) sebacate |
| 8 | 2,6-di-t-butyl-4-methylphenol |
| 9 | triphenylamine |
| 10 | triethylamine |

The resultant photosensitive member was installed into an electrophotographic copying machine (EP-50; made by Minolta Camera K.K.) and tested with application of a voltage of −6KV to the d.c. power supply to measure the initial surface potential $V_0$(V), the amount of exposure required for $V_0$ to reduce half of $V_0$ ($E_{\frac{1}{2}}$ (lux.sec)), and the initial surface potential decay rate $DDR_1$ (%) when the photosensitive member was allowed to stand in the dark for 1 second after charging.

Further, the developing apparatus was taken apart from the copying machine, and then, the electrophotographic process was repeated 5000 times to measure the initial surface potential ($V_0$), the amount exposure ($E'_{\frac{1}{2}}$), and initial surface potential decay rate ($DDR'_1$).

During the process above mentioned, the charger for the photosensitive member and the transporting charger were worked continuously.

The obtained results are shown in Table 4.

TABLE 4

| | initial | | | after repeated 5000 times | | |
|---|---|---|---|---|---|---|
| | $V_0$ (V) | $E_{\frac{1}{2}}$ (lux · sec) | $DDR_1$ (%) | $V_0'$ (V) | $E_{\frac{1}{2}}'$ (lux · sec) | $DDR_1'$ (%) |
| Ex. No. | | | | | | |
| 1 | −650 | 0.7 | 3.0 | −630 | 0.7 | 3.2 |
| 2 | −650 | 0.7 | 3.2 | −610 | 0.6 | 3.8 |
| 3 | −650 | 0.7 | 2.8 | −630 | 0.8 | 3.0 |
| 4 | −660 | 0.8 | 2.4 | −640 | 0.9 | 2.8 |
| 5 | −670 | 0.8 | 2.1 | −660 | 0.7 | 2.5 |
| 6 | −650 | 0.9 | 3.0 | −620 | 0.8 | 3.7 |
| 7 | −650 | 0.8 | 2.9 | −630 | 0.8 | 3.4 |
| 8 | −660 | 0.9 | 2.7 | −620 | 0.8 | 3.8 |
| 9 | −650 | 1.0 | 2.9 | −630 | 0.9 | 3.3 |
| 10 | −660 | 0.7 | 2.6 | −620 | 0.7 | 3.6 |
| 11 | −660 | 0.7 | 3.0 | −610 | 0.7 | 3.7 |
| 12 | −650 | 0.6 | 2.8 | −600 | 0.5 | 4.0 |
| 13 | −660 | 0.6 | 2.8 | −620 | 0.5 | 3.7 |
| 14 | −660 | 0.7 | 2.7 | −635 | 0.6 | 3.0 |
| 15 | −660 | 0.7 | 2.6 | −630 | 0.7 | 3.2 |
| 16 | −670 | 0.8 | 2.4 | −660 | 0.9 | 2.9 |
| Com. Ex. No. | | | | | | |
| 1 | −650 | 0.8 | 3.6 | −320 | 0.4 | 13.6 |
| 2 | −700 | 10.4 | 1.5 | −650 | 12.3 | 2.5 |
| 3 | −700 | 17.5 | 1.6 | −740 | 28.0 | 1.3 |
| 4 | −600 | 0.8 | 5.3 | −250 | 0.3 | 21.5 |
| 5 | −590 | 0.7 | 6.0 | −280 | 0.3 | 20.0 |
| 6 | −660 | 2.8 | 3.2 | −500 | 2.4 | 5.3 |
| 7 | −700 | 4.2 | 2.0 | −730 | 5.6 | 2.2 |
| 8 | −660 | 0.8 | 2.8 | −580 | 0.5 | 4.0 |
| 9 | −660 | 0.9 | 2.6 | −500 | 0.7 | 4.3 |
| 10 | −670 | 1.3 | 2.4 | −520 | 1.8 | 4.0 |

Photosensitive members obtained in Example 1, Comparative Example 1, Comparative Example 4 and Comparative Example 7 were installed into a copying machine (EP-50); made by Minolta Camera K.K.) to repeat the copying process 10000 times. After the repetition, the initial surface potential $V_0$(V), and the potential after irradiated $V_i$ (V) and the quality of copied images were evaluated. The results are shown in Table 5. In the evaluation of copied images, the symbol "o" means "good in practical use", "x" means "questionable in practical use".

TABLE 5

| | initial stage | | | after repeated 10000 times | | |
|---|---|---|---|---|---|---|
| | $V_0$ (V) | Vi (V) | quality of copied images | $V_0$ (V) | Vi (V) | quality of copied images |
| Example 1 | −650 | −100 | o | −650 | −100 | o |
| Com. Ex. 1 | −630 | −120 | o | −490 | −80 | x*) |
| Com. Ex. 4 | −650 | −120 | o | −350 | −70 | x**) |
| Com. | −680 | −210 | o | −700 | −280 | x***) |

TABLE 5-continued

| | initial stage | | | after repeated 10000 times | | |
|---|---|---|---|---|---|---|
| | $V_0$ (V) | Vi (V) | quality of copied images | $V_0$ (V) | Vi (V) | quality of copied images |
| Ex. 7 | | | | | | |

*)decrease of density and poor reproducibility of fine lines
**)decrease of density
***)fogs The photosensitive member of Example 1 formed good copied images, but the photosensitive members of Comparative Examples brought about such the deterioration of copied images as decrease of density of copied images, decrease of reproducibility of fine lines, fogs and the like.

Further, the coating solution prepared in Example 1 was not changed in quality even after 6 months, but the coating solution prepared in Comparative Example 1 showed the increase of the viscosity and the small color change towards yellow.

What is claimed is:

1. A photosensitive member with a charge generating layer and a charge transporting layer laminated on an electrically conductive substrate, in which the charge transporting layer comprises a charge transporting material and an aniline derivative represented by the following general formula (I) below:

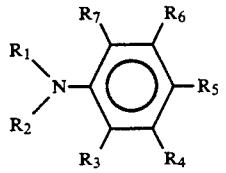

(I)

in which $R_1$ and $R_2$ are respectively an alkyl group or an aralkyl group, each of which may have a substituent; at least two groups among $R_3$–$R_7$ are respectively an alkyl group, an alkoxy group, a hydroxy group, an aryl group, an aralkyl group or a halogen atom, said aniline derivative is contained at a content of 1 to 30 percent by weight on the basis of the amount of the charge transporting material.

2. A photosensitive member of claim 28, in which $R_1$ and $R_2$ are respectively a $C_1$–$C_3$ alkyl group, a benzyl group which may have a substituent, or a phenethyl group which may have a substituent.

3. A photosensitive member of claim 1, in which $R_3$–$R_7$ are respectively a hydrogen atom, a $C_1$–$C_3$ alkyl group, a $C_1$–$C_3$ alkoxy group, a hydroxy group, a phenyl group, a benzyl group, a phenethyl group or a halogen atom.

4. A photosensitive member of claim 1, in which $R_3$–$R_7$ are respectively a $C_1$–$C_3$ alkyl group, a $C_1$–$C_3$ alkoxy group, a hydroxy group, a phenyl group, a benzyl group, a phenethyl group or a halogen atom.

5. A photosensitive member of claim 1, in which $R_3$, $R_5$ and $R_7$ are respectively an alkyl group.

6. A photosensitive member of claim 1, in which the charge transporting material is a butadiene compound represented by the following general formula (II) below:

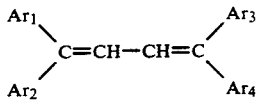

(II)

in which $Ar_1$, $Ar_2$, $Ar_3$ and $Ar_4$ are respectively an aryl group, at least one group among $Ar_1$, $Ar_2$, $Ar_3$ and $Ar_4$ has a substituent.

7. A photosensitive member of claim 1, in which the charge transporting material is a distyryl compound represented by the following general formula (III) below:

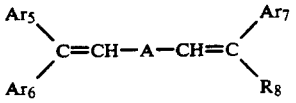

(III)

in which $Ar_3$, $Ar_6$ and $Ar_7$ are respectively an aryl group or a residual group of a heterocyclic ring; A is an alkylene group, an arylene group or a bivalent group of a heterocyclic ring, each of which may have a substituent; $R_8$ is a hydrogen atom, an alkyl group, an aralkyl group or an aryl group, each of which except for the hydrogen atom may have a substituent.

8. A photosensitive member of claim 1, in which the charge transporting layer comprises further a binder resin.

9. A photosensitive member of claim 8, in which the charge transporting material is contained at the content of 0.02–2 parts by weight on the basis of one part by weight of the binder resin.

10. A photosensitive member of claim 1, in which the charge transporting layer is 3–40 μm in thickness.

11. A photosensitive member of claim 1, in which the charge generating layer is 0.01–2 μm in thickness.

12. A photosensitive member of claim 1, in which a surface protective layer is formed on the charge transporting layer.

13. A photosensitive member of claim 6, in which the substituent is a halogen atom, a lower alkoxy group, a N-substituted amino group or a lower alkyl group.

14. A photosensitive member of claim 7, in which at least one of $Ar_5$, $Ar_6$ and $Ar_7$ is an aryl group having a substituent or a residual group of heterocyclic ring having a nitrogen atom or an oxygen atom.

15. A photosensitive member of claim 14, in which the substituent is a lower alkoxy group, a substituted amino group, or a lower alkyl group.

16. A photosensitive member of claim 1, in which $R_3$–$R_7$ are respectively a $C_1$–$C_3$ alkyl group or a $C_1$–$C_3$ alkoxy group.

17. A photosensitive member of claim 16, in which $R_3$ and $R_5$ are respectively a $C_1$–$C_3$ alkyl group or a $C_1$–$C_3$ alkoxy group; $R_4$, $R_6$ and $R_7$ are a hydrogen atom.

18. A photosensitive member of claim 16, in which $R_4$ and $R_6$ are respectively a $C_1$–$C_3$ alkyl group or a $C_1$–$C_3$ alkoxy group; $R_3$, $R_5$ and $R_7$ are a hydrogen atom.

19. A photosensitive member of claim 16, in which $R_3$, $R_5$ and $R_7$ are respectively a $C_1$–$C_3$ alkyl group or a $C_1$–$C_3$ alkoxy group; $R_4$ and $R_6$ are a hydrogen atom.

20. A photosensitive member of claim 1, in which a surface protective layer is formed on the photosensitive layer.

21. A photosensitive member having a laminated photosensitive layer comprising a charge generating layer and a charge transporting layer on an electrically conductive substrate, in which an outermost surface region of the photosensitive member comprises an aniline derivative represented by the following general formula (I) below:

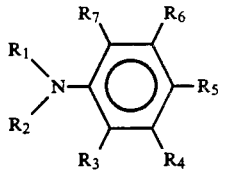

(I)

in which $R_1$ and $R_2$ are respectively an alkyl group or an aralkyl group, each of which may have a substituent; at least two groups among $R_3$–$R_7$ are respectively an alkyl group, an alkoxy group, a hydroxy group, an aryl group, an aralkyl group or a halogen atom, said aniline derivative being contained at a content of 1 to 30 percent by weight on the basis of the amount of the charge transporting material in the photosensitive member.

22. A photosensitive member of claim 21, in which $R_3$ and $R_5$ are respectively a $C_1$–$C_3$ alkyl group or a $C_1$–$C_3$ alkoxy group; $R_4$, $R_6$ and $R_7$ are a hydrogen atom.

23. A photosensitive member of claim 21, in which $R_4$ and $R_6$ are respectively a $C_1$–$C_3$ alkyl group or a $C_1$–$C_3$ alkoxy group; $R_3$, $R_5$ and $R_7$ are a hydrogen atom.

24. A photosensitive member of claim 21, in which $R_3$, $R_5$ and $R_7$ are respectively a $C_1$–$C_3$ alkyl group or a $C_1$–$C_3$ alkoxy group; $R_4$ and $R_6$ are a hydrogen atom.

25. A photosensitive member of claim 21, which comprises an overcoat layer formed on the photosensitive layer.

26. A photosensitive member of claim 25, in which an outermost surface region of the photosensitive member is an overcoat layer.

27. A photosensitive member of claim 21, in which an outermost surface region of the photosensitive member is a charge generating layer.

28. A photosensitive member of claim 21, in which an outermost surface region of the photosensitive member is a charge transporting layer.

* * * * *